United States Patent [19]

Tamburro

[11] Patent Number: 4,494,816

[45] Date of Patent: Jan. 22, 1985

[54] COAXIAL CABLE CONNECTOR

[75] Inventor: Peter J. Tamburro, Hanover Township, Morris County, N.J.

[73] Assignee: AT&T Bell Laboratories, Murray Hill, N.J.

[21] Appl. No.: 517,635

[22] Filed: Jul. 27, 1983

[51] Int. Cl.[3] ..... H01R 17/18

[52] U.S. Cl. ..... 339/177 R; 339/256 R

[58] Field of Search ..... 339/177, 256 R, 256 RT, 339/258 R, 258 RR, 182, 183

[56] References Cited

U.S. PATENT DOCUMENTS

| | | | |
|---|---|---|---|
| 3,051,925 | 8/1962 | Felts | 339/177 R |
| 3,439,294 | 4/1969 | Flanagan et al. | 339/177 R |
| 3,537,061 | 10/1970 | Haag et al. | 339/183 |
| 3,681,739 | 8/1972 | Kornick | 339/94 C |
| 3,784,962 | 1/1974 | Byrd | 339/182 R |
| 3,811,226 | 5/1974 | Gangelhoff et al. | 51/80 R |
| 4,180,301 | 12/1979 | Hutter | 339/90 C |
| 4,406,512 | 9/1983 | Schell | 339/177 R |

FOREIGN PATENT DOCUMENTS

| | | | |
|---|---|---|---|
| 2074798 | 11/1981 | United Kingdom | 339/177 R |
| 2079549 | 1/1982 | United Kingdom | 339/177 R |

OTHER PUBLICATIONS

Brochure for Nicholas-Edge Honing Machine-2 illustrative pages.

Tru Hone Knife Sharpener Manual-3 pages.

Bunker Ramo Corp., "A New Coaxial Cable Assembly Affording Quick Positive Coupling . . . ", Eleventh Annual Connector Symposium Procedings, Oct. 25-26, 1978.

*Primary Examiner*—Joseph H. McGlynn
*Assistant Examiner*—David L. Pirlot
*Attorney, Agent, or Firm*—W. H. Kamstra

[57] ABSTRACT

A connector (10) for directly connecting a coaxial cable (32) to the terminal pins (11, 12) of an interconnection system backplane (14). A two-part assembly comprises an outer conductive housing (15) having a narrow hollow stem (16) and an inner insulative plug (17) having a central aperture opening on an inner cavity (22) and at least one other aperture (18) opening on a slot (26) formed in the surface of the plug (17). A contact (23) fitted within the cavity (22) is adapted to receive at one end a backplane terminal pin (12) and at the other end to receive the stripped central conductor (33) of the coaxial cable (3) which conductor (33) is passed through the hollow stem (16). The shielding (35) of the cable (32) is drawn over the stem (16) for electrical contact and the outer housing (15) has stamped in its surface an arcuate detent (28) to present a contacting surface in the slot (26) for a terminal pin (11) when the connector (10) is assembled with the pins (11, 12).

7 Claims, 2 Drawing Figures

COAXIAL CABLE CONNECTOR

TECHNICAL FIELD

This invention relates to electrical interconnection apparatus and devices and particularly to such apparatus for making electrical connections between coaxial cables and other electrical terminations.

BACKGROUND OF THE INVENTION

Backplanes having fields of electrical terminal pins extending therethrough to complete electrical connections in electrical interconnection systems are well-known in the art. Typically, the pins at one side of the backplane are connected by wire-wrapping or other means to electrical conductors which complete circuits to other points within an interconnection frame or to external components and frames. As is known, the pins may also make electrical contact with layers of printed wiring carried by the backplane itself. At the other side of the backplane, the pins may complete circuits by means of suitable connectors with the wiring and electrical components carried by circuit boards and the like. The connectors and boards are readily fitted to and removed from the pins and a number of advantageous arrangements for correctly and quickly performing these functions are also known in the art.

When individual cables, such as coaxial cables rather than circuit boards, for example, are to be connected to a terminal pin or pins at the side being discussed, the same type of connection has frequently been employed as that on the other side of the backplane such as wire-wrapping or soldering, for example. At best, in order to facilitate installation and removal, a socket connector member is first fitted to the terminal pin or pins and the coaxial cable, terminating in a matching connector, is thereby connected to the terminal pin socket connector. The former electrical connection is cumbersome and its completion time consuming particularly in view of the fact that, not only must the cable center conductor be connected, but the cable shield must also be suitably separated and individually terminated. The latter connecting arrangement disadvantageously requires a separate terminal pin connector which may serve only a single coaxial cable. It is accordingly an objective of this invention to achieve a coaxial cable backplane terminal pin interconnection arrangement in which the component parts are reduced to a minimum and which is readily installed and disassembled.

SUMMARY OF THE INVENTION

One illustrative connector arrangement according to the principles of the invention comprises an outer conductive housing terminating in a hollow, smaller diameter stem and an insulative plug fitted within the housing. The plug is provided with a central cavity in which is fitted an electrical contact dimensioned at one end to receive a backplane terminal pin and at the other to receive a coaxial cable central conductor. In one embodiment, the plug has formed in its outer surface diametrically opposite slots also dimensioned to receive backplane terminal pins. The connector thus far described is fitted to a prepared coaxial cable by inserting its central conductor and its insulation into the open end of the stem, the stripped conductor end making electrical connection with one of the receiving ends of the contact within the plug cavity. The braided shielding of the cable is drawn over the housing stem where electrical contact is made. The cable may be maintained in place by a conventional ferrule crimped about the outer insulation of the coaxial cable at its end. The conductive outer housing of the connector is indented at the outer slots of the insulative plug to present within the slots arcuate contact surfaces. The outer slots and central cavity are spaced to correspond to the spacing of the terminal pins of the backplane with which the connector is to be employed. When the terminal pins—in this illustrative case, three—have been located on the backplane, the coaxial cable connector is fitted thereon. The central terminal pin is thus electrically connected to the cable central conductor and may complete a signal or power circuit while the outer terminals may complete a ground circuit via the coaxial cable shielding to which they are connected through the connector outer housing.

BRIEF DESCRIPTION OF THE DRAWING

The organization of one illustrative coaxial cable connector according to the principles of the invention will be better understood from a consideration of the detailed description of one specific embodiment thereof which follows when taken in conjunction with the accompanying drawing in which.

DETAILED DESCRIPTION

Figure 1:
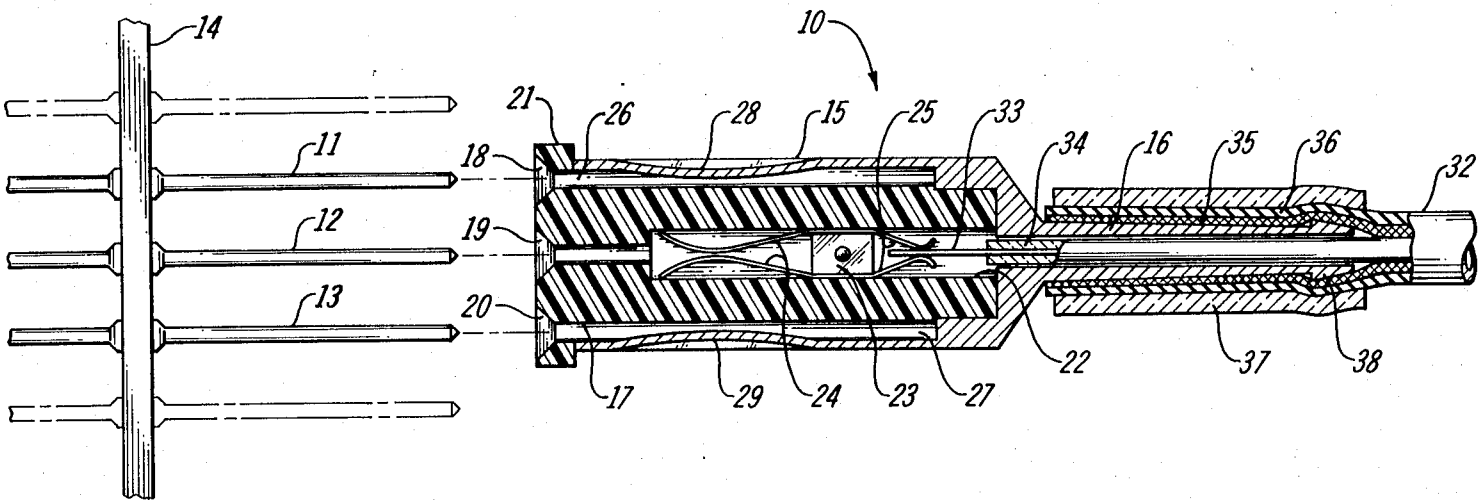
FIG. 1 is a cross-section view of an illustrative connector according to the invention shown fitted to the end of a coaxial cable and in position for the plug-in of representative backplane terminal pins.
Figure 2:
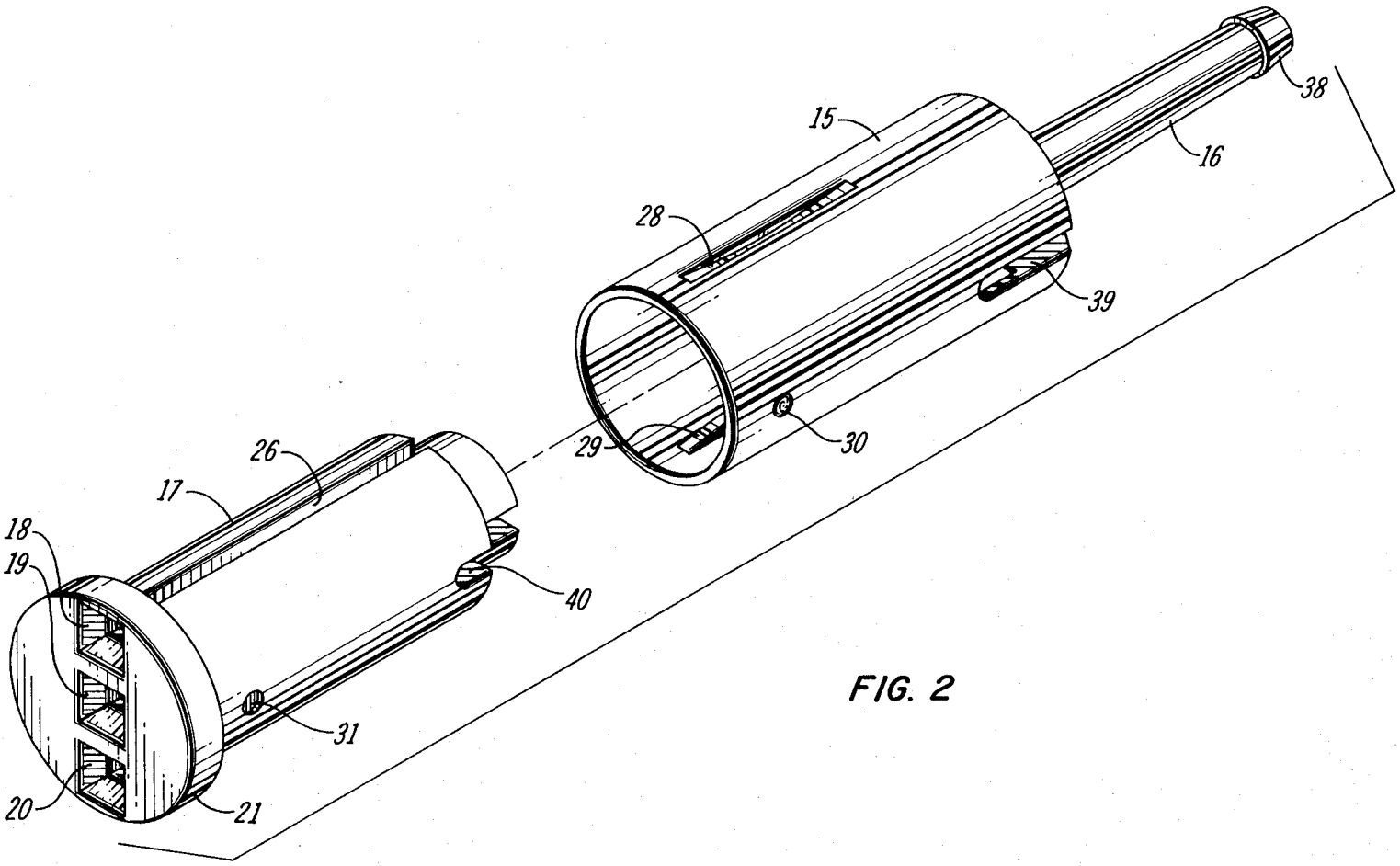
FIG. 2 shows in exploded view additional details of the connector components shown in cross-section in FIG. 1.

A cross-section assembled view of an illustrative coaxial cable connector 10 is shown in FIG. 1 in position to be fitted to selected electrical terminal pins 11, 12, and 13 extending through the plated-through holes of a portion of a typical interconnection system backplane 14. The terminal pins are conventionally square in cross-section and are equally spaced with adjoining pins on each side. The ends of the pins at the left side of backplane 14 as viewed in the drawing are typically permanently connected to electrical cabling completing circuits to other components and terminals within the system. Coaxial cable connector 10 (see also FIG. 2) comprises an outer, cylindrical conductive housing 15 open at one end and terminating at the other end in an open ended, slightly tapered stem 16 of a substantially smaller diameter than that of housing 15. Fitted within housing 15 through its open end is an insulative cylindrical plug 17 presenting at one end in the embodiment being described three diametrically aligned access cones 18, 19, and 20 and apertures dimensioned to receive terminal pins 11, 12, and 13. Plug 17 may be provided at one end with an annular flange 21 to facilitate its seating within housing 15. The central pin receiving aperture extending from access cone 19 opens within plug 17 on a cavity 22 in which is fitted a typical electrical contact 23. Contact 23 presents at each end a pair of facing contact spring blades 24 and 25, the spring blades of each pair being curved toward each other to clasp therebetween an electrical conductor. Pin receiving cones 18 and 20 open into slots 26 and 27, respectively, cut into the outer surface of plug 17 parallel to the longitudinal axis of the plug, only slot 26 being visible in FIG. 2. Slots 26 and 27 are dimensioned to slidably receive terminal pins 11 and 13, or any other two terminal pins spaced apart from a central, third pin.

Outer housing 15 has stamped or otherwise formed therein and spaced to accord with the spacing of slots 26 and 27 in plug 17, a pair of spring contact surfaces 28 and 29 inwardly curved and dimensioned to fit into slots 26 and 27 when the two components are assembled (FIG. 1). When so assembled, a dimple 30 formed in housing 15 snapped into a recess 31 in the surface of plug 17 may serve to retain the two components together. Preparatory to mounting the connector so far described on the end of a conventional coaxial cable 32, the latter has its central conductor 33 suitably stripped of its inner insulation 34 a short distance, its braided shielding 35 and outer insulation 36 being stripped a somewhat longer distance. Coaxial cable 32 is joined to connector 10 by feeding central conductor 33 and inner insulation 34 through hollow stem 16 of housing 15 while at the same time shielding 35 and outer insulation 36 are drawn over the outside of stem 16. Cable 32 is suitably stripped so that, as the ends of shielding 35 and insulation 36 seat against the base of housing 15, inner conductor 33 will have been forced between spring blade pair 25 of contact 23 to make positive electrical contact at that point. The forced drawing of shielding 35 of cable 32 over stem 16 also ensures a large area of electrical contact between the two. In order to prevent cable 32 from beaing inadvertently drawn off connector 10, a ferrule 37 may be crimped about cable 32 at its end, an annular detent 38 formed at the end of stem 16 serving to lock shielding 35 and insulation 36 in place as cable 32 is clasped by ferrule 37. A port 39 may be formed in housing 15 and an aligned port 40 may be formed in plug 17 through which the connection between inner conductor 33 and blade pair 25 may be accessed for soldering and inspection.

Connector 10 and its mounted coaxial cable 32 may now be fitted to selected backplane terminal pins 11, 12, and 13 by simply aligning access cones 18, 19, and 20, respectively, and urging outer pins 11 and 13 between curved spring surfaces 28 and 29 and the bottom of slots 26 and 27 where positive electrical contact is ensured with surfaces 28 and 29. At the same time, central terminal pin 12 is similarly urged between spring blade pair 24 to make electrical contact at that point. Two ground connections are thus completed between coaxial cable shielding 35 and terminal pins 11 and 13 and a signal or power connection is completed between central conductor 33 and terminal pin 12. It will be appreciated that, although the specific connector embodiment considered in the foregoing was described as cylindrical, any other cross-sectional configuration is contemplated as being within the scope of the invention. Further, plug 17 and housing 15 may be adapted to receive fewer or more terminal pins than the representative three shown in the drawing.

Accordingly, what has been described is considered to be only one specific illustrative coaxial cable connector arrangement according to the principles of the invention. It is thus to be understood that various and numerous other arrangements may be devised by one skilled in the art without departing from the spirit and scope of the invention as limited only by the accompanying claims.

What is claimed is:

1. A coaxial cable connector comprising an insulative plug having a first electrical terminal pin receiving aperture at one end opening on an inner cavity in said plug an opening on the other end, and a second electrical terminal pin receiving aperture at said one end opening on a slot formed in a surface of said plug, an electrical contact fitted in said cavity, said contact presenting electrical terminal pin contacting means at one end facing said first aperture and electrical conductor contacting means at the other end facing said other end of said plug, and a conductive housing fitted about said plug, said housing being formed to present an electrical contact surface extending into said slot, said housing terminating in a hollow stem dimensioned within to receive the inner insulation of a coaxial cable and without to receive about it the shielding of a coaxial cable.

2. A coaxial cable connector as claimed in claim 1 in which said terminal pin contacting means and said conductor contacting means comprises, respectively, a first and a second pair of facing blades adapted to frictionally receive therebetween a terminal pin and an electrical conductor.

3. A coaxial cable connector as claimed in claim 1 or 2 in which said housing and said plug have aligned access ports formed therein at said conductor contacting means.

4. A coaxial cable connector assembly for interconnecting a coaxial cable to electrical terminal pins of a backplane comprising an insulative plug having a first electrical terminal pin receiving aperture at one end opening on an inner cavity in said plug an opening on its other end, and a second electrical terminal pin receiving aperture at said one end opening on a slot formed on a surface of said plug dimensioned to receive an electrical terminal pin, an electrical contact fitted within said cavity, said contact presenting a first pair of facing blades at one end adapted to frictionally receive therebetween an electrical terminal pin and presenting a second pair of facing blades at the other end, a conductive housing fitted about said plug, said housing being formed to present an electrical contact surface extending into said slot, said slot being dimensioned to receive an electrical terminal in frictional electrical contact with said contact surface, said housing terminating in a hollow stem, and a coaxial cable having an inner insulated conductor fitted within said hollow stem, said inner conductor being frictionally fitted between said second pair of facing contact blades, said connector having shielding fitted about said stem.

5. A coaxial cable connector assembly as claimed in claim 4 in which said housing and said plug have aligned ports for permitting access to said inner conductor and said second pair of facing contact blades.

6. A coaxial cable connector assembly as claimed in claim 5 in which said plug and said housing are substantially cylindrical.

7. A coaxial cable connector comprising an insulative plug having a central first electrical terminal pin receiving aperture at one end opening on an inner cavity in said plug, an opening on the other end, and second and third electrical terminal pin receiving apertures at said one end on opposite sides of said central first aperture, said second and third apertures opening on slots formed in the surface of said plug, an electrical contact fitted in said cavity, said contact presenting a first and a second pair of facing blades adapted to frictionally receive therebetween an electrical terminal pin and an electrical conductor, respectively, and a conductive housing fitted about said plug, said housing being formed to present electrical contact surfaces extending into said slots, said housing terminating in a hollow stem dimensioned within to receive the inner insulation of a coaxial cable and without to receive about it the shielding of a coaxial cable.

* * * * *